United States Patent [19]

Draghi

[11] 4,008,385

[45] Feb. 15, 1977

[54] AUTOMOBILE CIGARETTE LIGHTER

[76] Inventor: William Draghi, 37-24 95th St., Jackson Heights, N.Y. 11372

[22] Filed: Apr. 19, 1976

[21] Appl. No.: 678,217

[52] U.S. Cl. ..... 219/269; 219/264; 219/267

[51] Int. Cl.[2] ..... F23Q 7/22

[58] Field of Search ..... 219/264, 267, 269

[56] References Cited

UNITED STATES PATENTS

| | | | |
|---|---|---|---|
| 2,692,938 | 10/1954 | Cone | 219/269 X |
| 2,918,559 | 12/1959 | Pramaggiore | 219/269 |
| 3,692,976 | 9/1972 | Pramaggiore | 219/264 |
| 3,975,619 | 8/1976 | Uda | 219/269 |

FOREIGN PATENTS OR APPLICATIONS

| | | | |
|---|---|---|---|
| 570,238 | 12/1957 | Italy | 219/269 |
| 934,123 | 8/1963 | United Kingdom | 219/269 |

*Primary Examiner*—Volodymyr Y. Mayewsky
*Attorney, Agent, or Firm*—J. B. Felshin

[57] ABSTRACT

The dashboard of the automobile has an opening through which a tubular casing projects behind the dashboard. On the casing is a bell having a tubular extension telescoped on the casing. The bell, its extension and the casing are clamped to the dashboard. A trigger is pivoted to the tubular extension and has a hammer to strike the bell, a trigger finger projecting into the casing, and a spring to bias the hammer against the bell. Slidably and removably mounted in said casing is a push-pull unit comprising a plug telescoped within a sleeve and adopted to be moved forwardly relative to the sleeve to compress a coil compression spring between the plug and sleeve. The plug carries an element adopted to be heated to glowing condition when the plug is pushed relative to the sleeve and casing to compress said compression spring, as it moves to a position where said element is grippingly engaged by a spring clamp at the end of said casing, and which clamp carries current from the battery when fingers of the clamp grip said element, to thereby heat said element to glowing condition. When said element is sufficiently heated, the spring clamp opens up automatically because the spring fingers of the clamp expand outwardly and release the plug, so that the compression spring between the plug and sleeve retracts the plug relative to the sleeve as it moves to normal condition. As the plug was pushed into heating position it engaged the finger of the trigger and retracted the hammer away from the bell thereby tensioning the trigger spring. When the element is sufficiently heated, the plug is released and moves back and recedes to normal position, thereby allowing the trigger spring to swing the hammer against the bell to strike the bell and make a sound which signals the operator of the automobile to pull out the plug and its sleeve as a unit and light his cigarette. Without such signal, the operator might forget to pull out the push-pull unit and use it.

9 Claims, 7 Drawing Figures

AUTOMOBILE CIGARETTE LIGHTER

This invention relates to automobile cigarette lighters. Automobile cigarette lighters are known which comprise a pushpull unit comprising a plug carrying a heating element and telescopingly passing through a sleeve, with a coil compression spring between the plug and sleeve. Also such prior cigarette lighters comprised a casing with a spring clamp having fingers to grip the element of the plug, to be heated when gripped by the spring fingers of the clamp when they grip said element. In such prior devices, the spring clamp automatically opens up when the element is heated due to movement of the heated metal spring fingers of the clamp when an electric circuit is closed through the clamp end element, thereby releasing the element, and allowing the compressed spring between the plug and sleeve to retract the plug to normal position. The difficulty with such prior devices has been that often the operators forget to pull out the push-pull unit and light their cigarettes, when the element glows, thereby allowing the heated element to cool.

It is hence an object of this invention to provide a highly improved and audible signal when the element is heated and the push-pull unit moves back to normal condition, to alert the operator to pull out the unit and light the cigarette.

Another object of this invention is to provide a device of the character described which combines a push-pull unit provided with an electric heating element, with an audible signal device to alert the operator to remove the push-pull unit from the dashboard and use the lighter when the heating element is fully heated.

A further object of this invention is to provide a cigarette lighter of the character described which can replace the cigarette lighter now commonly installed in an automobile, easily and inexpensively.

Still another object of this invention is to provide a strong and durable cigarette lighter of the character described which shall be relatively inexpensive to manufacture, easy to install, safe in use and yet practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

FIG. 1 is an exploded view of the parts of the cigarette lighter embodying the invention and part of the dashboard on which the lighter is to be installed;

FIG 2. is a side view of the lighter installed on a dashboard, with parts broken away and in cross-section;

Figure 1:
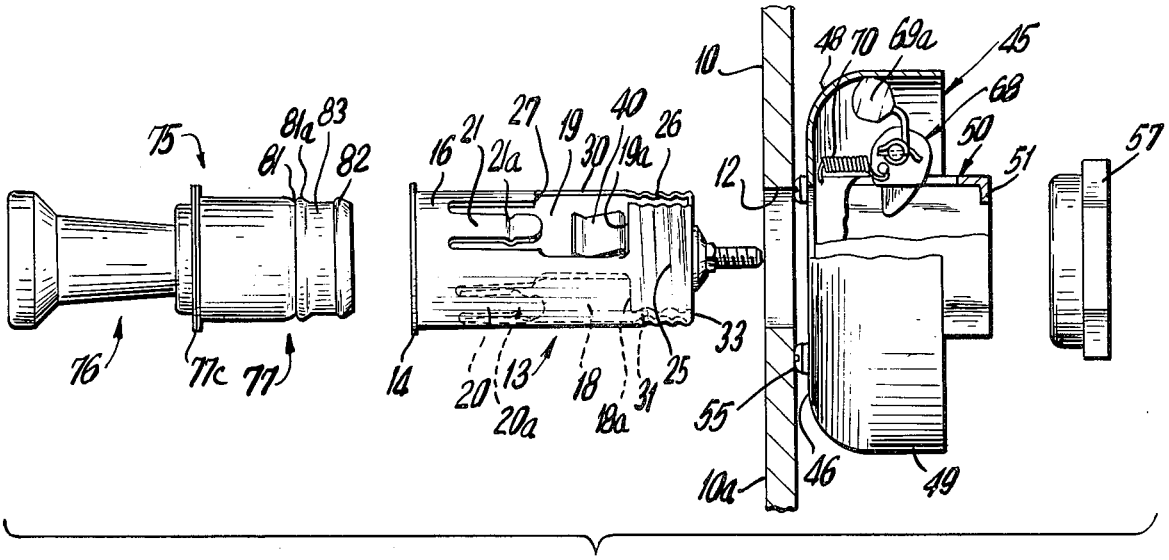
Figure 2:
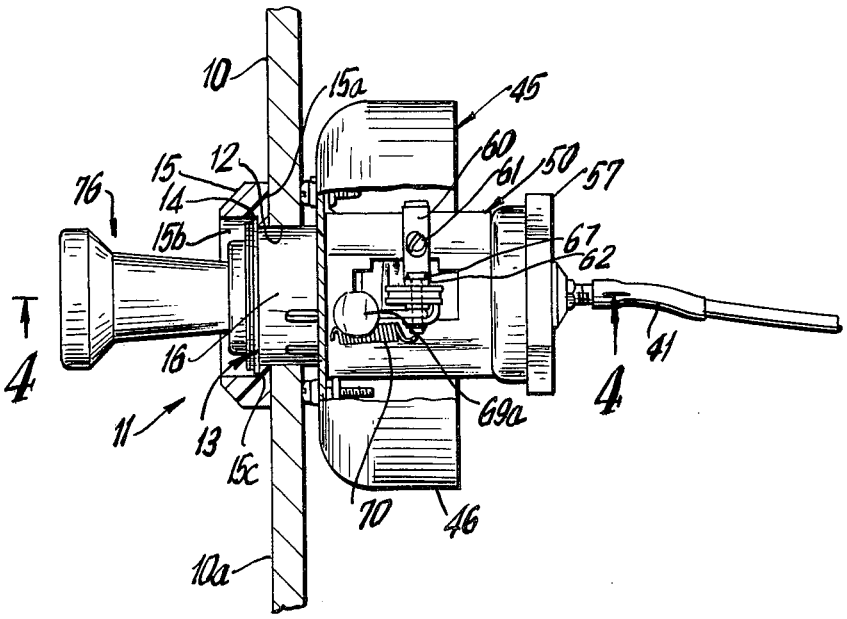
Figure 3:
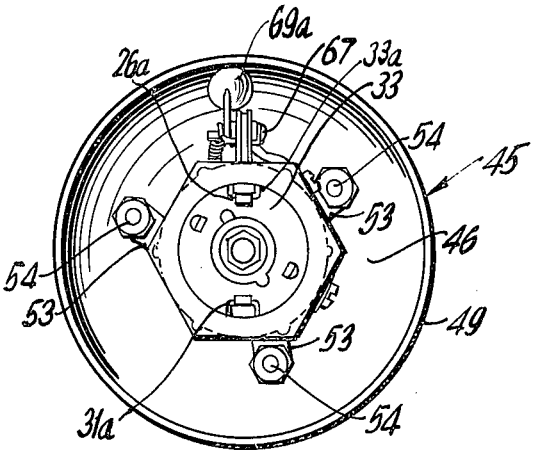
FIG. 3 is a rear end view of the lighter.

Referring now in detail to the drawing, 10 designates a dashboard of an automobile or other automotive vehicle, and 11 designates a cigarette lighter device mounted on said dashboard. The dashboard 10 has a circular opening 12. Extending through said opening 12 is a tubular casing 13. Said casing 13 has an annular outwardly extending flange 14 disposed in spaced relation to the surface 10*a* of the dashboard facing the inside of the passenger compartment. A bezel 15 has a surface 15*a* contacting surface 10*a* of the dashboard, a countersunk opening 15*b* and an inwardly extending annular flange 15*c* disposed between said flange 14 and surface 10*a*. Said casing 13 further comprises a tubular or cylindrical wall 16 extending from flange 14 and passing through said opening 12 and projecting into the space of the automobile behind the dashboard and within the hood of the automobile. Said casing 13 has a pair of longitudinal cut outs 18 and 19 at diametrically opposed sides thereof. Projecting forwardly (relative to the automobile) into cut out 18 is a longitudinal spring finger 20. Near the forward end of finger 20 is a radially inwardly extending stop bump 20*a*.

Projecting forwardly into cut out 19 is a spring finger 21 diametrically opposed to finger 20 and similarly shaped and in symmetrical relation thereto. Finger 21 has a bump 21*a* similar but symmetrically disposed relative to bump 20*a*. The cut outs 18, 19 are wider at their forward ends as shown in FIG. 1 and have end edges 18*a*, 19*a*, respectively, spaced from the front end of wall 16. Between the edges 18*a*, 19*a* and the front end of tubular wall 16, is an externally threaded portion 25 for the purpose hereinafter explained. Said portion 25 has a slot 26 offset from slot 19 and extending from the forward end of tubular wall 16 to a shoulder 27 near the forward end of spring finger 21 forming a straight longitudinal edge 30. Said portion 25 of tubular cylinder 16 is also formed with a longitudinal slot 31 offset from cut out 18 and diametrically opposed to cut out 26, but terminating longitudinally at about edge 18*a* of cut out 18. This slot 31 does not extend rearwardly as far back as slot 26. Thus the threaded wall 25 does not extend angularly 360° since it has the two diametrically opposed, longitudinal slots 26, 31. Extending radially inwardly from the forward end of threaded wall 25 is an annular flange 33. The flange 33 has diametrically opposed slots merging with slots 26*a*, 31*a*, 26, 31 for the purpose hereinafter appearing.

Disposed within the front end of tubular wall 16 is a unit 35 well known in automobile cigarette lighters now in use. Such unit comprises bimetallic spring fingers 40 electrically connected to a wire passing into a cable 41 which leads to one terminal of the automobile battery B or any low voltage electrical source. The other terminal of the battery is grounded. As will appear hereinafter, the spring fingers are designed to grip a grounded element (described hereinafter) that will heat up upon engagement with said spring fingers 40. The element is such that it will heat up and glow upon becoming gripped by springs 40 to complete a circuit to the battery, sufficient to light a cigarette, as will appear hereinafter. Since unit 35 is well known, it will not be described in detail. Unit 35 is fixed to flange 33 in any suitable well known manner.

Surrounding the casing 13 is a bell 45 having an annular wall 46 provided with a central hole 47. Extending from wall 46 is an annular wall 48 of curved transverse cross section from which a cylindrical wall 49 extends. The bell is open forwardly. Attached centrally to said bell is a cylindrical tube 50 having at its front end a pair of radially inwardly projecting fingers 51, 52 aligned with slots 26, 31, respectively, and projecting thereinto. Extending from the rear end of tube 50 are apertured ears 53 equiangularly spaced apart and contacting the forward face of wall 46 and attached thereto by screws 54 having heads 55 between wall 46 and dashboard 10.

Said tube 50 is formed with a longitudinal slot 56. A nut 57 is screwed to the threaded forward end 25 of tubular wall 15 to clamp the bell and its tube 50 as well as casing 13 to the dashboard.

Attached to tube 50 is a part cylindrical bracket 60 (by means of bolts 61). Bracket 60 has an upwardly extending radial lip 62 located inside of the bell 45. On lip 62 is a pivot pin 67. Pivoted on pin 67 is a trigger 68 having a finger 69 projecting down through slots 56, 26 into the interior of casing 13. Said trigger 68 is in a plane passing through the axis of casing 13.

Figure 4:
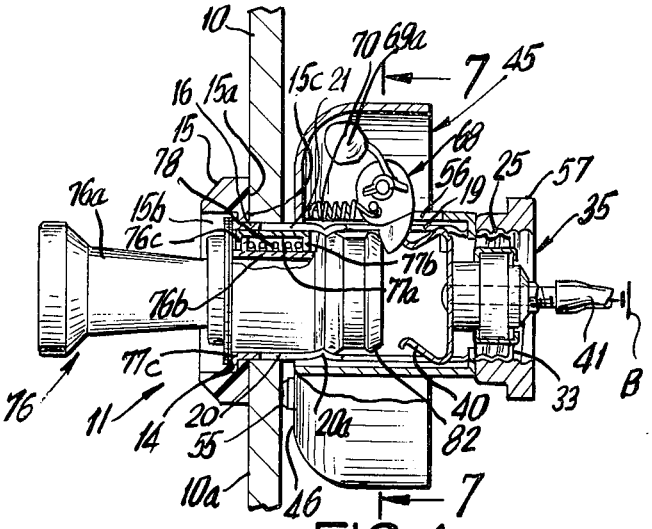
FIG. 4 is a cross-sectional view taken on line 4—4 of FIG. 2, and showing the lighter in normal, non-use position with the push pull unit in normal non-heating position in a tubular casing on the dashboard and the hammer resting against the bell.

Fixed to the trigger 68 for rotation therewith about the pivot pin 67 is a hammer 69*a*. A coil tension spring 70 interconnects a portion of trigger 68 below pivot pin 67 and outside of tubular wall 50 with wall 46 of bell 45, for biasing the trigger in a clockwise direction, looking at FIG. 6. In the normal position of FIG. 4, the hammer 69 substantially contacts the inner surface of wall 49 of the bell, as shown in FIG. 4.

Removably, slidably and rotatably mounted on said casing 13 is a push-pull lighter unit 75 comprising a plug 76 telescoping within a sleeve 77. Such unit is well known. Said plug 76 comprises a handle or finger engageable head 76*a* from which a tubular portion 76*b* extends. Extending outwardly from tube 76*b* is an annular shoulder 76*c*. Sleeve 77 comprises a sleeve portion 77*a* having an annular inwardly extending shoulder 77*b*. Between shoulders 76*c* and 77*b* is a coil compression spring 78 which biases the plug 76 to the left looking at the drawing, relative to the sleeve 77.

At the right end of plug 76 is fixed an element 80 adopted to heat up when electric current is passed therethrough. Sleeve 77 has an outwardly extending annular flange 77*c* at its left end adapted to contact annular flange 14 on casing 45 to limit movement of said sleeve to the right, as shown in FIG. 4 of the drawing. Sleeve 77 is formed with an annular external groove 81 forming an annular bead 81*a* adapted to receive the bumps 20*a*, 21*a* which snap into said groove 81 when the push pull unit is pushed into casing 13 to the position of FIG. 4. Element 80 is grounded.

Sleeve 77 also has an annular bead 82 at its right outer end, and an annular groove 83 wider than groove 81, between annular beads 81*a*, 82.

In normal condition when the pull-push unit 75 is removed from the casing 13, or when in the casing 13 but in the normal, unheating condition of FIG. 4, the element 80 is aligned with the bead 82 but is of less outer diameter than the internal diameter of said bead. The springs 20, 21 are of such tension as to allow the push-pull unit to be inserted into casing 13 without causing any relative movement between the pulg 76 and the sleeve 77. During such action, bumps 20*a*, 21*a* of springs 20, 21 merely snap over the beads 82, 81*a*. Also at the end of such action the trigger finger is substantially engaged by bead 82.

In such position the heating element 80 is not heated and remains cold.

Obviously, the push-pull unit can be pulled entirely out of the casing 13 from the position of FIG. 4. However, when it is not desired to light a cigarette or use the lighter, the push-pull unit remains in the FIG. 4 position thereof.

Figure 5:
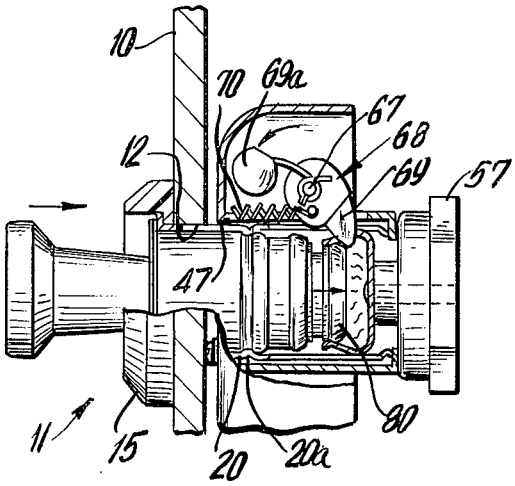
FIG. 5 is a view similar to FIG. 4 but showing the push pull unit in heating position.

When it is desired to light a cigarette (or a cigar), the operator first pushes the plug 76 to the right, looking at the drawing, to the position of FIG. 5, In the FIG. 5 position the periphery of the heating element 80 enters between the spring fingers 40. During such action, the plug 76 moves to the right relative to sleeve 77, thereby compressing coil compression spring 78. During such action furthermore element 80 contacts the trigger finger 69 and rotates the trigger to the FIG. 5 position and hence moves hammer 69*a* away from the bell, thereby tensioning the coil tension spring 70.

In the FIG. 5 position, with the heating element gripped by and between spring fingers 40, the push-pull unit 75, with the plug 76 moved relative to the sleeve 77, is held by fingers 40. In the FIG. 5 position, current passes through the heating element until it glows. When the heating element glows, the spring fingers heat up sufficiently to move outwardly away from each other, or otherwise relax the spring clamp action on the element 80 to allow compressed spring 78 to retract plug 76 back to the FIG. 4 position thereby allowing the tensioned spring 70 to rotate the trigger quickly in a clockwise direction to cause the hammer to strike the bell. The sound of the bell is an audible signal that the heating element is hot and that the unit 75 should be pulled out and used to light the cigarette or cigar.

In previous constructions, without this audible signal, the operator often did not notice that the heating element was hot and was not alerted to pull out the unit and use it, thereby permitting the element to cool.

Figure 6:
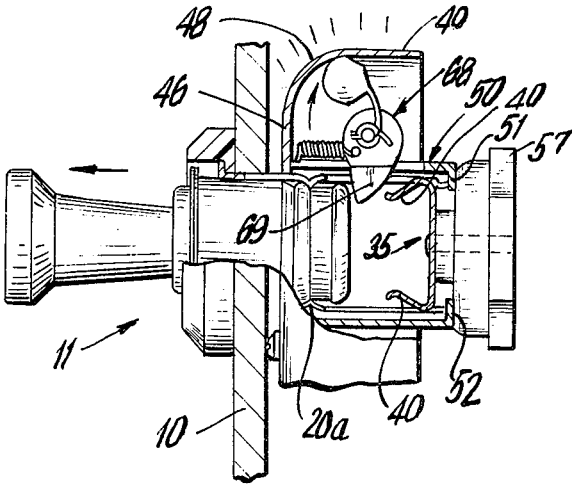
FIG. 6 is a view similar to FIG. 5 but showing the device pulled out slightly after the element was fully heated and the push pull unit released and moved back to normal position, sounding the bell and then pushed slightly outwardly on its way to being fully pulled out for use.
Figure 7:
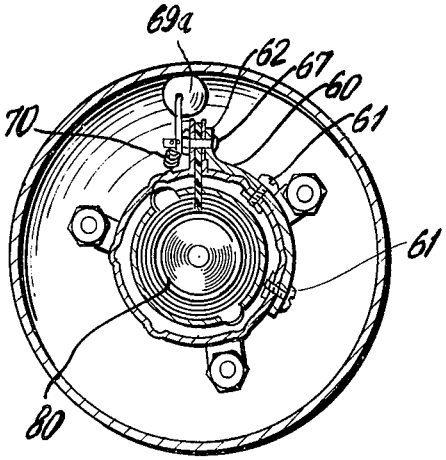
FIG. 7 is a cross-sectional view taken on line 7—7 of FIG. 4.

In FIG. 6, the unit is shown pulled out slightly, allowing the hammer to remain in its position.

Element 80 is grounded through sleeves or tubular portions 76*b*, 77 casing 13 and the dashboard of the automobile.

Fingers 51, 52 slide in slots 26, 31 to ensure that slots 26 and 56 are superposed, so that the trigger finger 69 will pass through said superposed slots.

An owner of an automobile can remove the usually supplied cigarette lighter and replace it with the cigarette lighter disclosed herein.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

The trigger 69 is preferably made of electric insulating material to prevent possible short circuiting, if the trigger should accidentally contact a finger 40.

I claim:

1. A cigarette and cigar lighter comprising a tubular casing, a push-pull unit comprising a sleeve slidable in said casing and a plug slidable in said sleeve, means to limit movement of said sleeve relative to said casing in one direction, in a predetermined position of said sleeve relative to said casing, said plug being movable relative to said sleeve, spring means interposed between said sleeve and plug and adapted to be loaded upon moving said plug relative to said sleeve in said direction, to a predetermined position of said plug relative to said casing, means to hold said plug in said predetermined position of said plug relative to said casing, an element on said plug adapted to heat up and glow upon receiving current, means to grip said element to complete an electric circuit through said element, to heat said element to glow, in said predetermined position of said plug relative to said casing and to automatically release said plug when said element is heated to a glowing condition, to allow said loaded spring means to retract said plug relative to said sleeve, and break said circuit through said element, audible signal means and means controlled by said plug, to actuate said signal means to produce an audible signal upon said plug being retracted, said audible signal means comprising a bell, a trigger pivoted relative to said bell, a hammer on said trigger adapted to strike said bell, spring means connecting said trigger to said bell to bias the trigger for rotation in one direction, and means on said plug adapted to rotate said trigger in an opposite direction to load the trigger spring means, upon moving said plug relative to said sleeve in said direction.

2. The combination of claim 1, a tubular extension on said bell, said casing and extension having superposed slots through which said trigger passes, said trigger having a finger inside said casing to be engaged by said plug.

3. The combination of claim 2, a dashboard having an opening, said casing passing through said opening, said bell surrounding said opening, and means to attach said bell and casing to said dashboard.

4. The combination of claim 3, and means on said casing to releasably retain said sleeve in said casing in said predetermined normal position of said sleeve relative to said casing, against movement of said sleeve in an opposite direction out of said casing.

5. The combination of claim 1, and means on said casing to releasably retain said sleeve in said casing in said predetermined normal position of said sleeve relative to said casing, against movement of said sleeve in an opposite direction out of said casing.

6. The combination of claim 1, a tubular extension on said bell, said casing and extension having superposed slots through which said trigger passes, said trigger having a finger inside said casing to be engaged by said plug, said extension having means slidably engaging in said superposed slots.

7. The combination of claim 6, a dashboard having an opening, said casing passing through said opening, said bell surrounding said opening, and means to attach said bell and casing to the dashboard.

8. The combination of claim 7, and means on said casing to releasably retain said sleeve in said casing in said predetermined normal position of said sleeve relative to said casing, against movement of said sleeve in an opposite direction out of said casing.

9. A cigarette and cigar lighter, comprising a member adapted to be attached to a dashboard of an automotive vehicle, audible signal means on said member, a tubular casing, means for attaching said casing to said member, a push-pull unit slidably mounted in said casing, said push-pull unit comprising a manually controlled plug slidable in a sleeve, and spring means to move said plug relative to the sleeve in one direction to a normal predetermined position relative to said sleeve, means to limit movement of said sleeve relative to said casing in one direction, a heating element on said plug, means on said casing to engage said element, upon moving said plug relative to said sleeve and casing in an opposite direction to a heating position and thereby load said spring means, and to hold said plug against retraction from such position, and means to heat said element while said element is engaged and held by said engage and hold means, and including means to release said element upon heating said element to a predetermined degree and thereby to permit the loaded spring means to move said plug relative to said sleeve in said first direction back to normal position of said plug relative to said sleeve, and means controlled by said plug to actuate said audible signal means upon being retracted by said loaded spring means to sound said audible signal means, said audible signal means comprising a bell, a trigger pivoted relative to said bell, a hammer on said trigger adapted to strike said bell, spring means connecting said trigger to said bell to bias the trigger for rotation in one direction, and means on said plug adapted to rotate said trigger in an opposite direction to load the trigger spring means, upon moving said plug relative to said sleeve in said direction, a tubular extension on said bell, said casing and extension having superposed slots through which said trigger passes, said trigger having a finger inside said casing to be engaged by said plug, said extension having means slidably engaging in said superposed slots.

* * * * *